US005556267A

United States Patent [19]

Hansen

[11] Patent Number: 5,556,267

[45] Date of Patent: Sep. 17, 1996

[54] DOUBLE ACTING PUMP

[75] Inventor: Craig N. Hansen, Minnetonka, Minn.

[73] Assignee: Hansen Engine Corporation, Minnetonka, Minn.

[21] Appl. No.: 332,527

[22] Filed: Oct. 31, 1994

Related U.S. Application Data

[63] Continuation-in-part of Ser. No. 4,478, Feb. 5, 1993, Pat. No. Des. 352,041.

[51] Int. Cl.[6] ..... F04B 11/00

[52] U.S. Cl. ..... 417/534; 417/571; 137/528; 92/138

[58] Field of Search ..... 417/534, 571; 137/528, 533, 533.17; 92/138, 177

[56] References Cited

U.S. PATENT DOCUMENTS

| | | | |
|---|---|---|---|
| 3,456,874 | 7/1969 | Graper | 417/534 |
| 3,776,667 | 12/1973 | Berglund et al. . | |
| 4,610,609 | 9/1986 | Milborn, Jr. | 417/534 |
| 4,657,488 | 4/1987 | Weinhandl | 417/534 |

*Primary Examiner*—Charles G. Freay

[57] ABSTRACT

A pump has an extruded metal housing surrounding a square internal chamber accommodating a piston assembly with square pistons. An eccentric member and block assembly associated with a driven shaft reciprocates the piston assembly to pump fluid. The flow of fluid into and out of the pumping chamber is controlled with intake and exhaust valves incorporated into plates mounted on opposite ends of the housing.

19 Claims, 8 Drawing Sheets

68
69
67
57
56
49
51
60
53
39
47
37
42
54
52
43
36
38
41
46
64
62
61
65
58
34
33
63
66
59
27
32

DOUBLE ACTING PUMP

CROSS REFERENCE TO RELATED APPLICATION

This application is a continuation-in-part of U.S. application Ser. No. 29/004,478, filed Feb. 5, 1993, now U.S. Pat. No. Des. 352,041.

FIELD OF THE INVENTION

The invention relates to double acting pumps for handling fluids, such as air, having a pair of pistons that are simultaneously reciprocated with a rotating eccentric cam.

BACKGROUND OF THE INVENTION

Double acting piston pumps having a cylinder accommodating a pair of pistons that are reciprocated by an eccentric cam roller for pumping air are known. H. A. Berglund and D. F. Thomas disclose in U.S. Pat. No. 3,776,667 a double acting pump having a pair of cylinders accommodating a pair of pistons for compressing air and liquid, and mixing the air with the liquid. An eccentric cam associated with the pistons operates to simultaneously reciprocate the pistons in their respective cylinders. Poppit-type check valves associated with each cylinder operate to control the flow of air and liquid through the respective cylinders during the reciprocation of the pistons in the cylinders. The pump is made from a number of separable parts so that it can be readily disassembled for cleaning and repair. The parts must be fabricated and machined which increases the manufacturing, labor and costs of the pump.

SUMMARY OF THE INVENTION

The invention is related to a double acting piston pump for handling fluids such as gas, air, liquids and the like. The pump has low cost extruded metal parts requiring a minimum of machining. The pump has a high volumetric efficiency and a relatively small size.

The preferred embodiment of the pump has an extruded metal square housing having an internal pumping chamber with normally disposed flat surfaces that accommodates a piston assembly having a pair of generally square reciprocating pistons. The internal surface of the housing surrounds the pumping chamber accommodating the piston assembly which divides the pumping chamber into two separate chambers located at opposite ends of the housing. Each piston has outer peripheral seals that are located in sliding engagement with the internal surface of the housing. An eccentric cam rotatably mounted on the housing operates to reciprocate the piston assembly relative to the internal surface of the housing. A pair of end caps mounted on opposite sides of the housing close the pumping chambers at the opposite ends of the housing. Annular intake and exhaust valve plates having intake and exhaust valving rings control the flow of fluid into and out of the pumping chambers. Fasteners retain the end caps and valve plates in assembled relation with opposite ends of the housing.

DESCRIPTION OF THE PREFERRED EMBODIMENT

Figure 1:
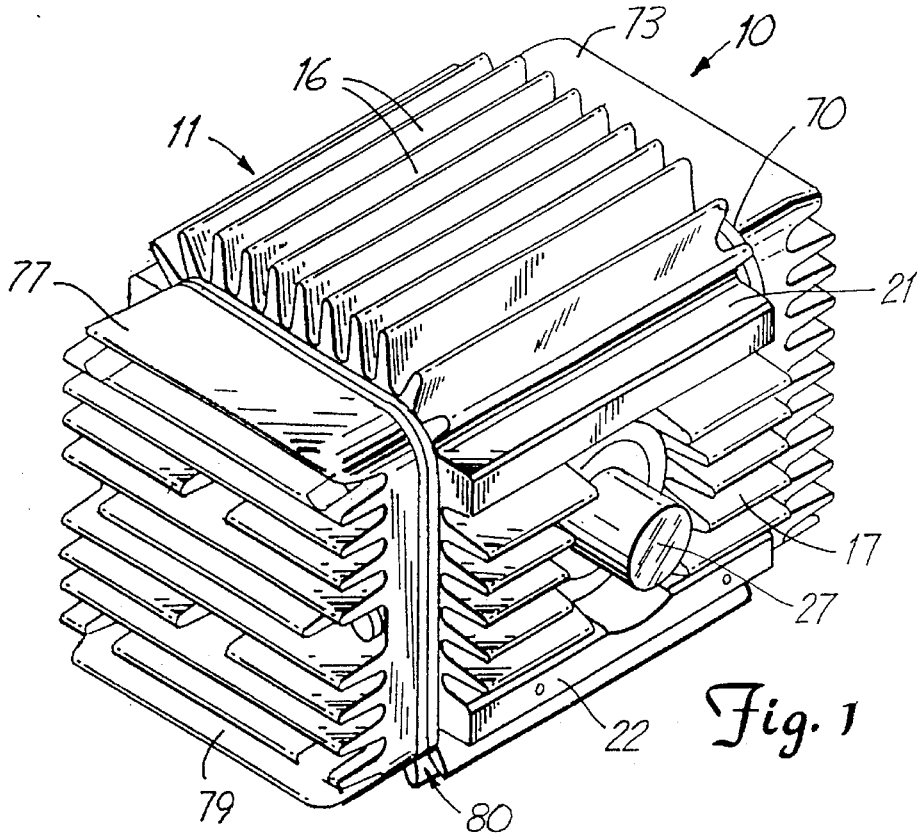
FIG. 1 is a perspective view of the pump of the invention.
Figure 2:
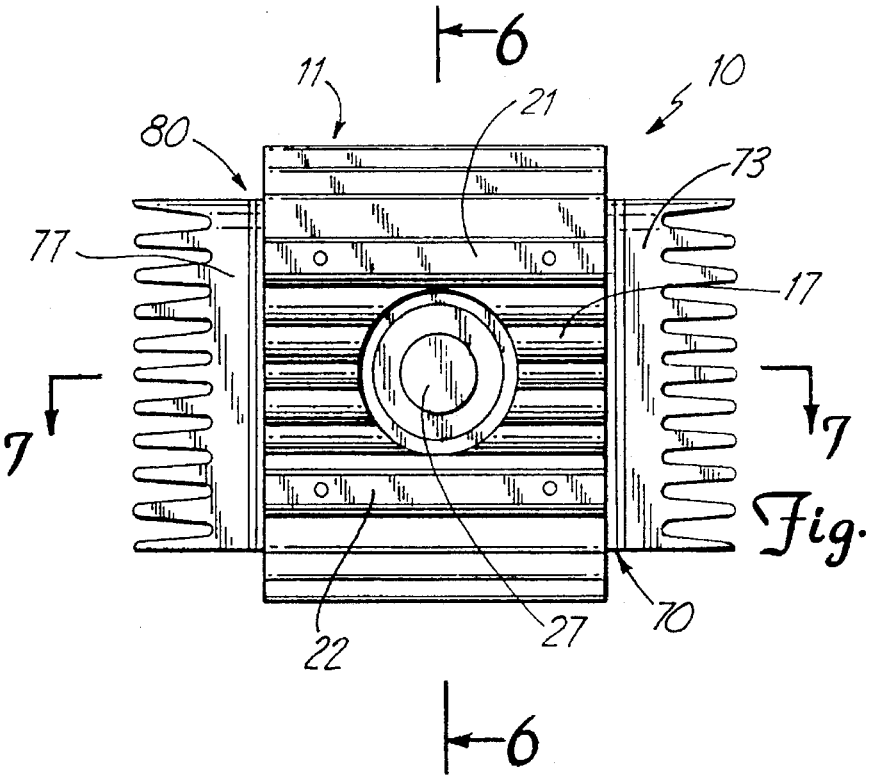
FIG. 2 is side elevational view of the right side thereof.
Figure 3:
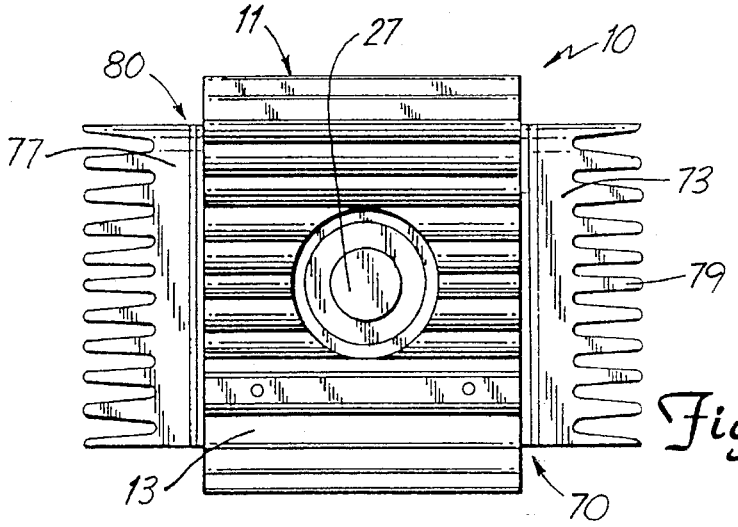
FIG. 3 is a side elevational view of the left side thereof.
Figure 4:
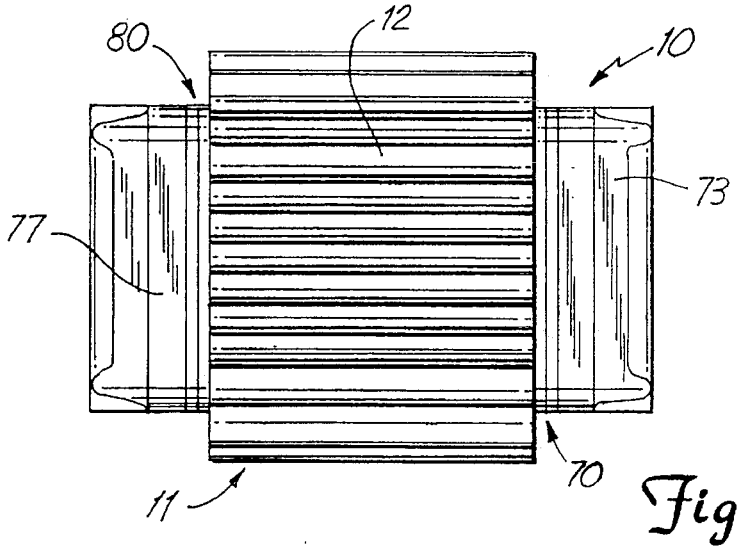
FIG. 4 is a top plan view thereof.

Referring to FIGS. 1–6, the double acting pump of the invention, indicated generally at 10, has a generally cubed-shaped housing 11. Housing 11 has four walls 12, 13, 14 and 15. Walls 12, 13 and 14 have a plurality of outwardly-directed longitudinal ribs 16, 17 and 18 to facilitate the cooling of the material of housing 11. Wall 13 has a longitudinal support member 19. Support members 21 and 22 are joined to wall 15. Members 19, 20 and 21 are adapted to be connected to a fixed support to anchor pump 10. Pump 10 is herein described as used as an air compressor to compress air. Other gases, liquids and fluid products can be pumped and compressed with pump 10.

Figure 6:
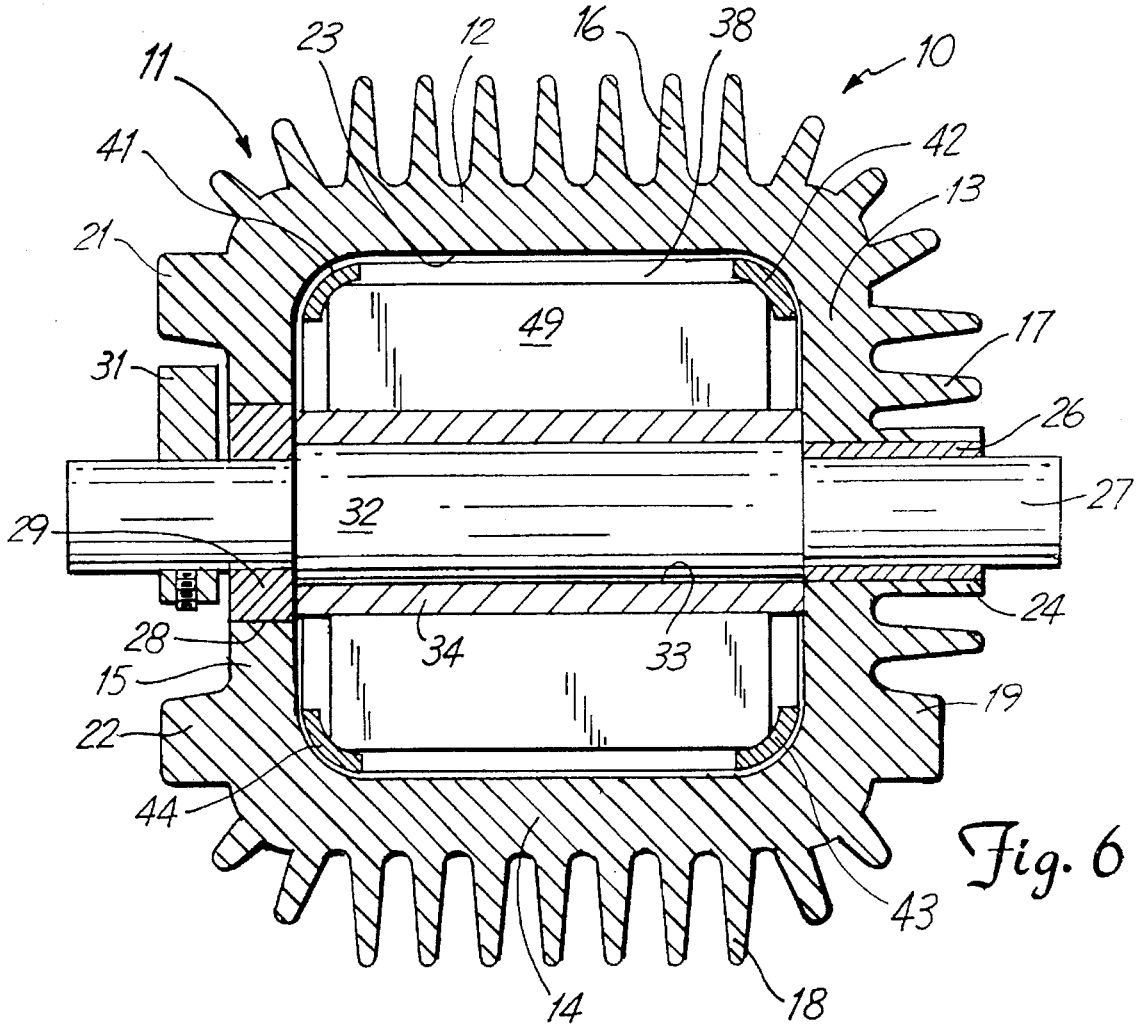
FIG. 6 is an enlarged sectional view taken along the line 6—6 of FIG. 2.
Figure 10:
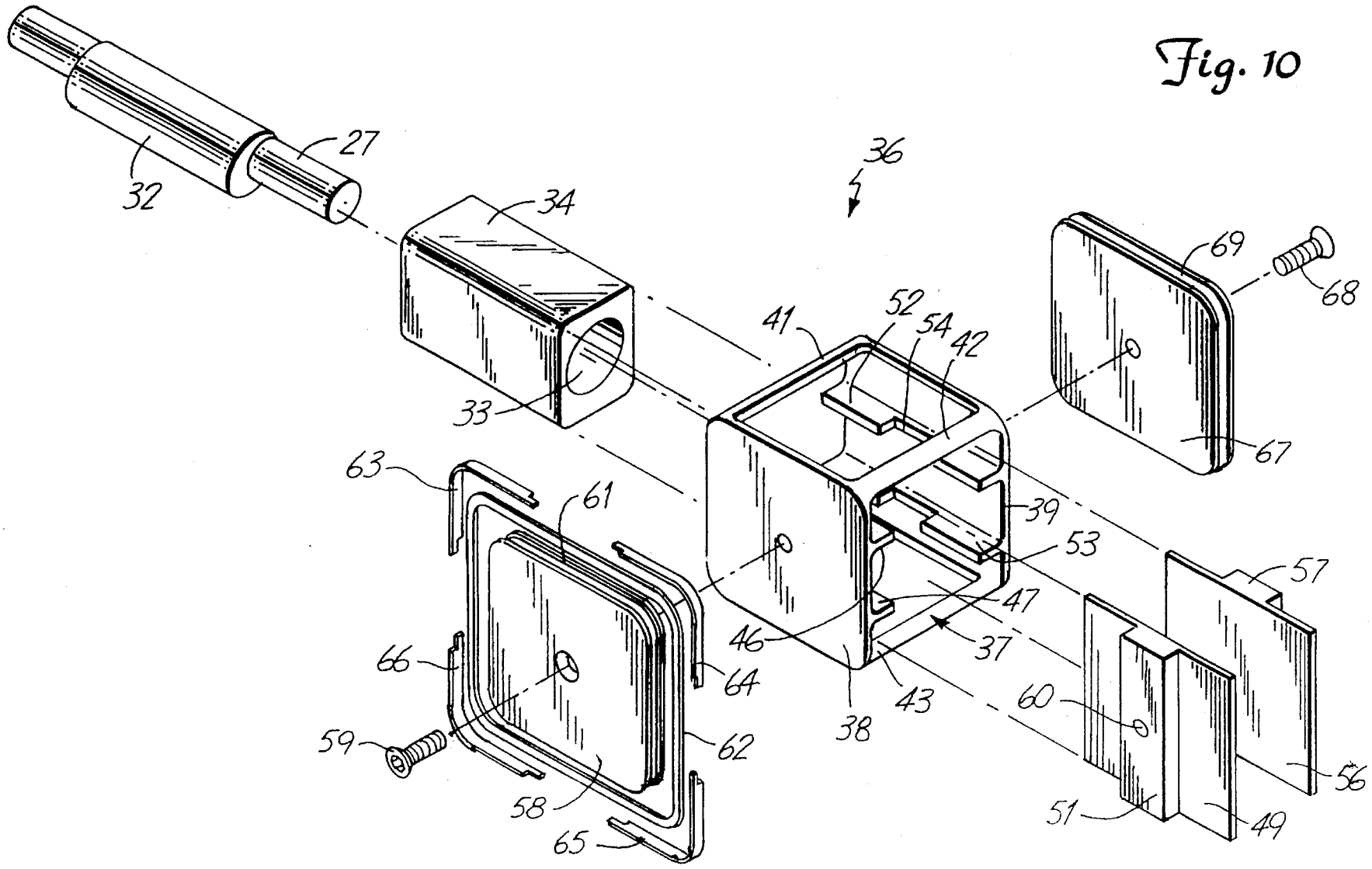
FIG. 10 is an exploded perspective view of the piston assembly and eccentric cam drive therefore.
Figure 11:
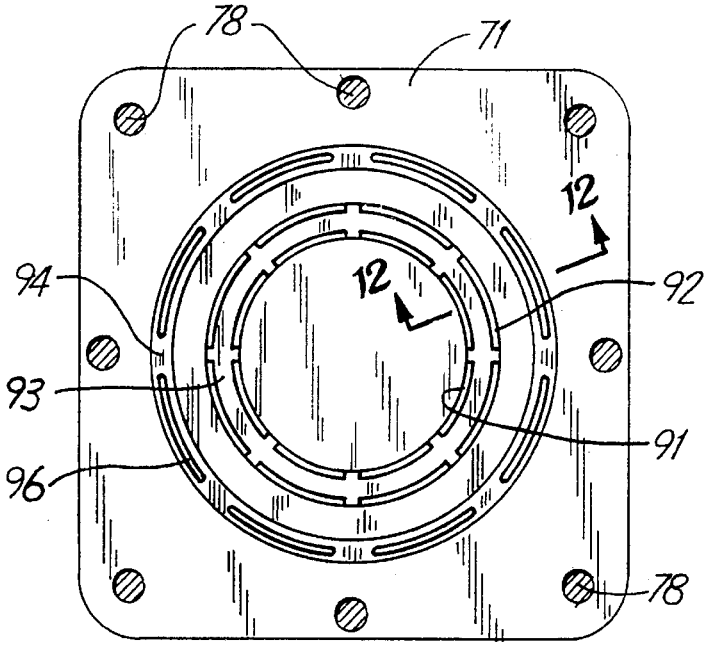
FIG. 11 is a sectional view taken along the line 11—11 of FIG. 7.
Figure 12:
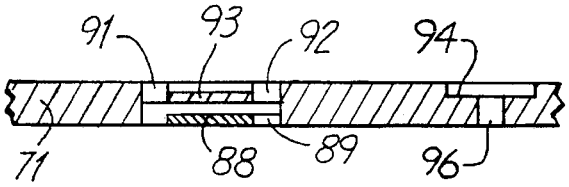
FIG. 12 is an enlarged sectional view taken along the line 12—12 of FIG. 11.
Figure 13:
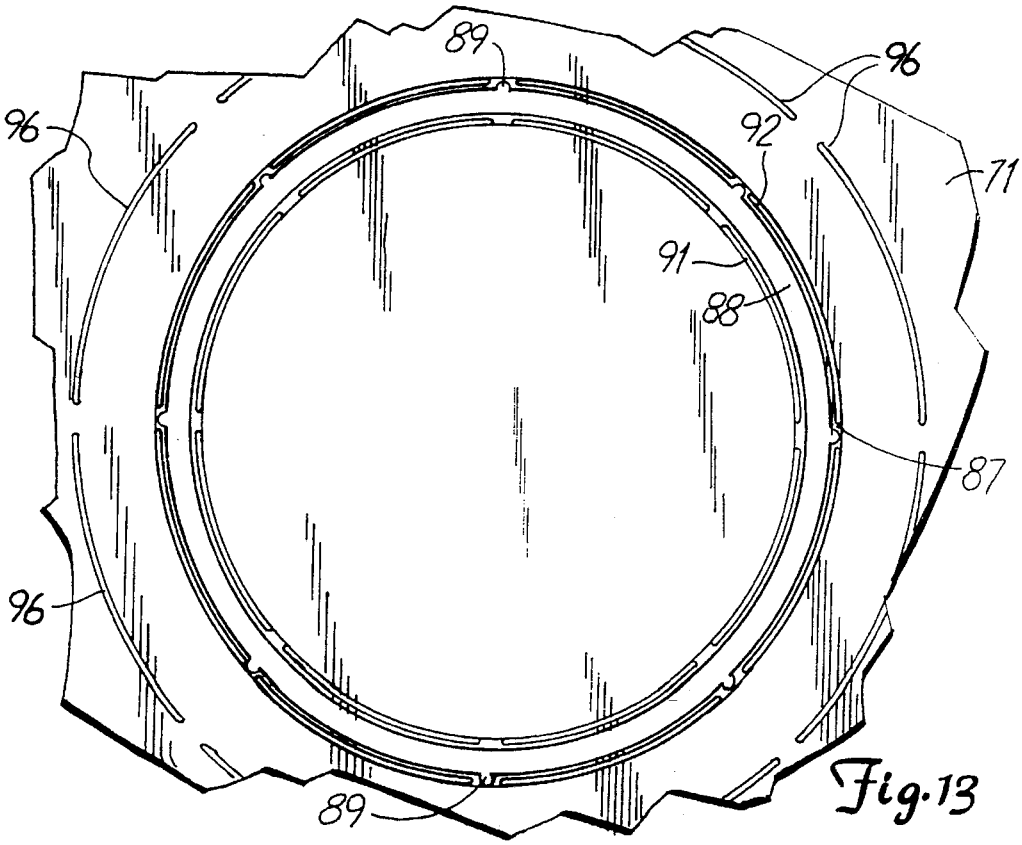
FIG. 13 is an enlarged sectional view taken along the line 13—13 of FIG. 7.
Figure 14:
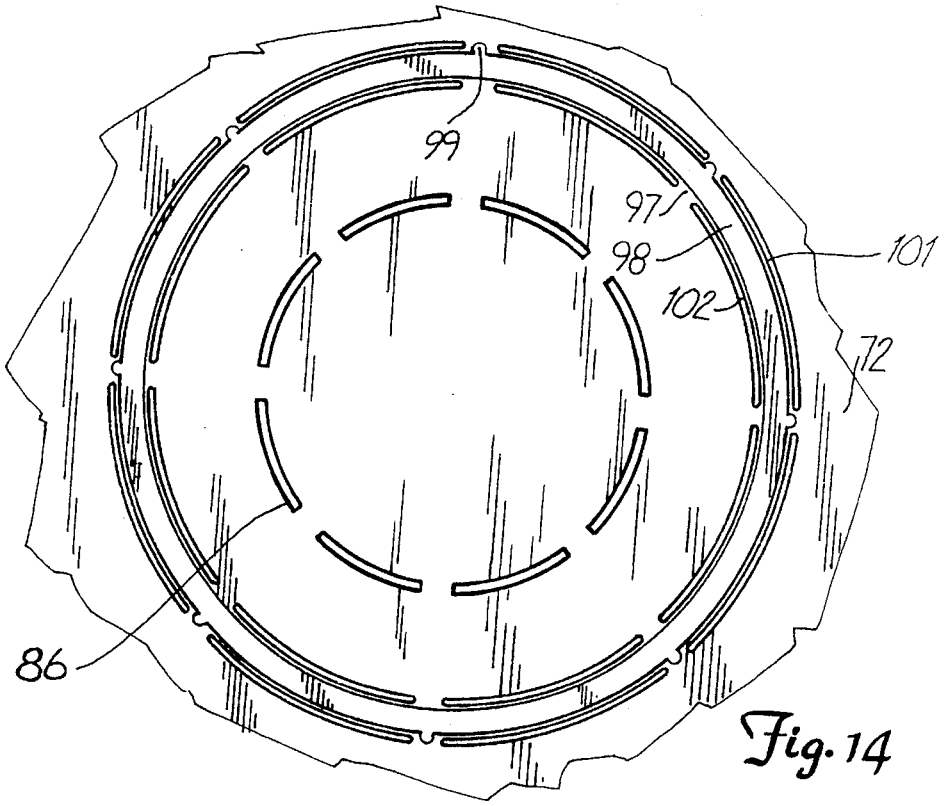
FIG. 14 is an enlarged sectional view taken along the line 14—14 of FIG. 7.
Figure 15:
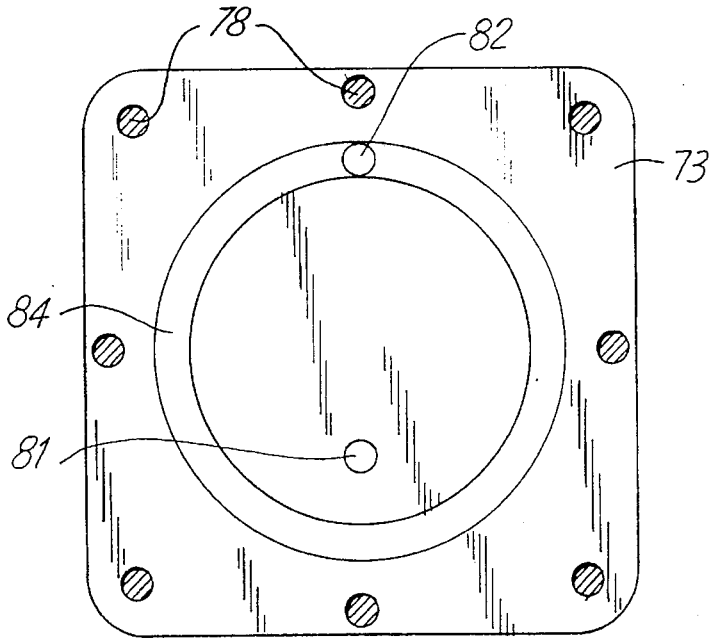
FIG. 15 is an enlarged sectional view taken along the line 15—15 of FIG. 7.

As seen in FIG. 6, walls 12, 13, 14 and 15 have an internal continuous surface 23, having a generally square configuration with rounded convex corners surrounding an elongated chamber having pumping chambers 25A and 25B at opposite ends of the housing. Housing 11 is a one-piece extruded metal part, such as extruded aluminum. Extruded metal parts are low in cost and do not require extensive manufacturing, labor and machining expenses. Housing 11 can be made of extruded plastic material. Wall 13 has an outwardly-directed boss 24 accommodating a sleeve bearing 26 supporting a shaft 27. Opposite wall 15 has a large hole 28 supporting a bearing 29 accommodating the opposite end of shaft 27. Shaft 27 has a central cylindrical eccentric member 32 located in a cylindrical bore 33 of an elongated rectangular block 34. A counter balance 31 is secured to the outer end of shaft 27 adjacent bearing 29. Shaft 27 is a drive shaft adapted to be connected to a prime mover, such as an electric motor, internal combustion engine, hydraulic motor and the like, operable to rotate shaft 27. Referring to FIG. 10, block 34 is operatively associated with a piston assembly, indicated generally at 36, for reciprocating the piston assembly in chambers 25A and 25B surrounded by internal surface 23.

Figure 7:
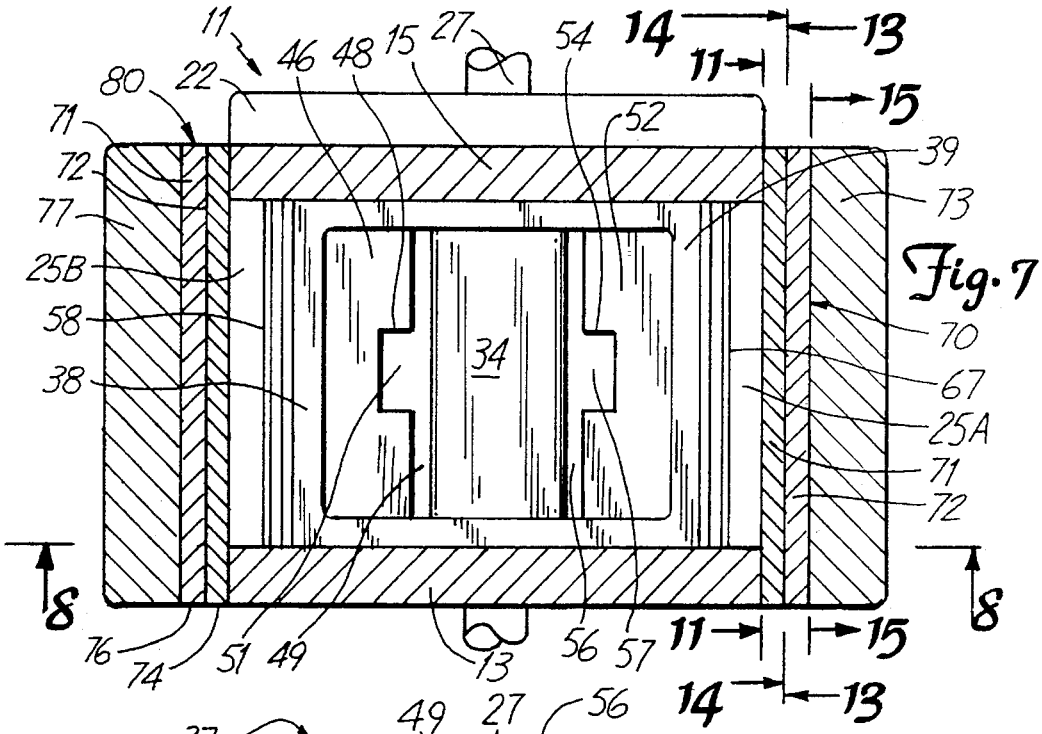
FIG. 7 is an enlarged sectional view taken along the line 7—7 of FIG. 2.

Piston assembly 36 has a box-shaped body 37 comprising a first upright wall 38 and a second upright wall 39. Corner members 41, 42, 43 and 44 are joined to the adjacent corners of walls 38 and 39, and space walls 38 and 39 laterally relative to each other. Wall 38 has a pair of inwardly-directed ribs 46 and 47 having a central slot 48, as seen in FIG. 7. A plate 49, bearing against ribs 46 and 47, has a tongue 51 that fits into slot 48. Plate 49 also has a flat surface that is located in surface engagement with one flat surface of block 34. Wall 39 has a pair of inwardly-directed generally horizontal ribs 52 and 53 that have vertical slots 54. A plate 56 bears against the inside edges of ribs 52 and 53. Plate 56 also has an inwardly-directed upright tongue 57 that fits into slot 54. Plate 56 has a generally flat vertical surface that is located in surface engagement with a surface of block 34. The flat surfaces of plates 49 and 56 allow block 34 to move up and down as eccentric member 32 rotates in bore 33. The rotating eccentric member 32 also simultaneously reciprocates plates 49 and 56, thereby moving piston assembly 36 relative to housing 11 to pump fluid as hereinafter described.

Figure 9:
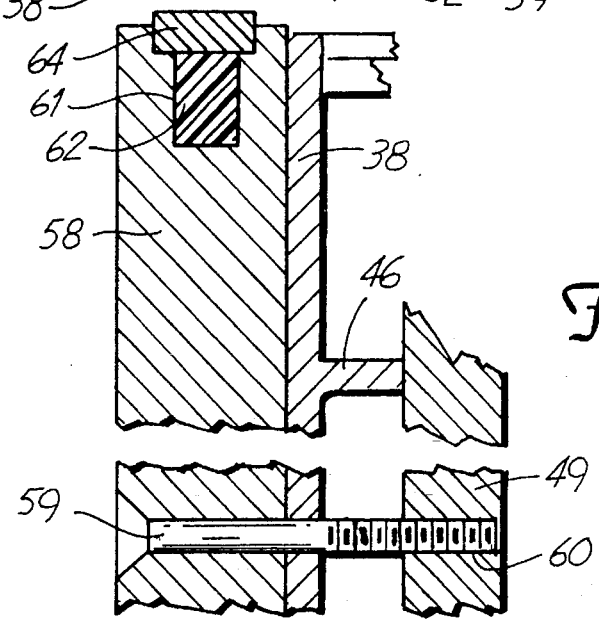
FIG. 9 is an enlarged fragmentary sectional view taken along the line 9—9 of FIG. 8.

A square piston 58 is located adjacent the outside surface of first wall 38. A bolt 59 secures piston 58 to wall 38 and holds plate 49 in engagement with ribs 46 and 47. Piston 58 is retained in surface engagement with first wall 38. As shown in FIG. 9, bolt 59 is threaded into a hole 60 located in the center of tongue 51.

The outer peripheral edge of piston 58 has a continuous annular groove 61 accommodating a generally square ring 62 and right angle sealing segments, 63, 64, 65 and 66. Sealing segments 63–66 are located in sliding sealing engagement with the internal surface 23 of housing 11. Ring 62 is a heat resistant plastic expansion member operable to bias sealing segments 63–66 into engagement with surface 23.

A second square piston 67 is located adjacent the outside surface of second wall 39 and secured to plate 56 with a bolt 68. Bolt 68 holds plate 56 in engagement with ribs 52 and 53. Second piston 67 has an outer peripheral seal 69. Seal 69 has the same structure as the seal ring 62 and the seal segments 63–66. Seal 69 is located in sliding sealing engagement with the internal surface 23 of housing 11.

Figure 5:
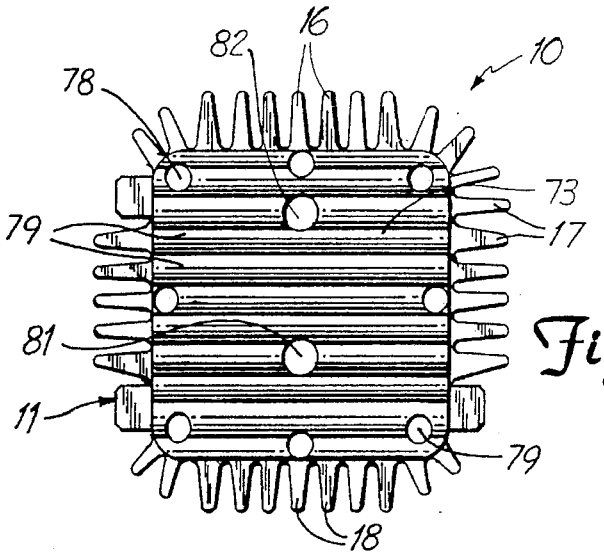
FIG. 5 is an end elevational view of the right end thereof.

The flow of fluid, such as air, into and out of the pumping chambers 25A and 25B is controlled with valve assemblies, indicated generally at 70 and 80. Valve assembly 70 has an intake valve plate 71 and an exhaust valve plate 72 secured to an end of housing 11 with bolts 78. Bolts 78 also secure end cap 73. Valve assembly 80 has an intake valve plate 74 and an exhaust valve plate 76. An end cap 77 secures the valve plates 74 and 76 to the opposite end of housing 11 with a plurality of bolts (not shown) similar to bolt 78, as seen in FIG. 5. End caps 73 and 77 can be fabricated from extruded metal, such as aluminum, to reduce manufacturing and machining costs.

Valve assembly 80 has the same structure as valve assembly 70. The following description is directed to valve assembly 80. Valve assembly 70 has the same parts as valve assembly 80 and operates to control the flow of fluid into and out of the pumping chamber in response to the reciprocable movement of the piston assembly 36.

Figure 16:
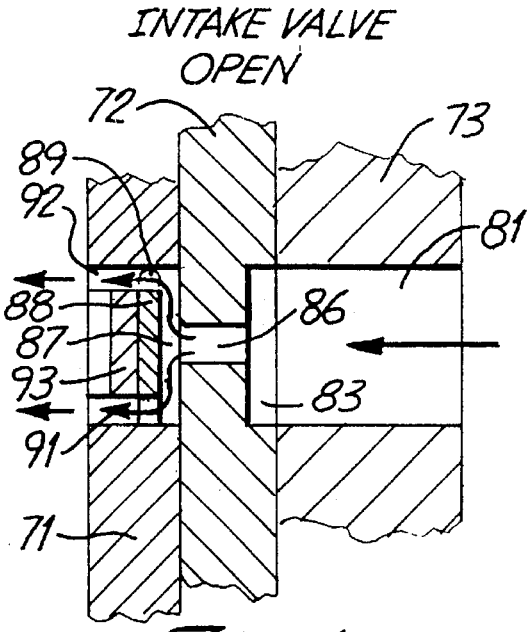
FIG. 16 is a sectional view showing the valve assembly with the intake valving ring in the open position.
Figure 17:
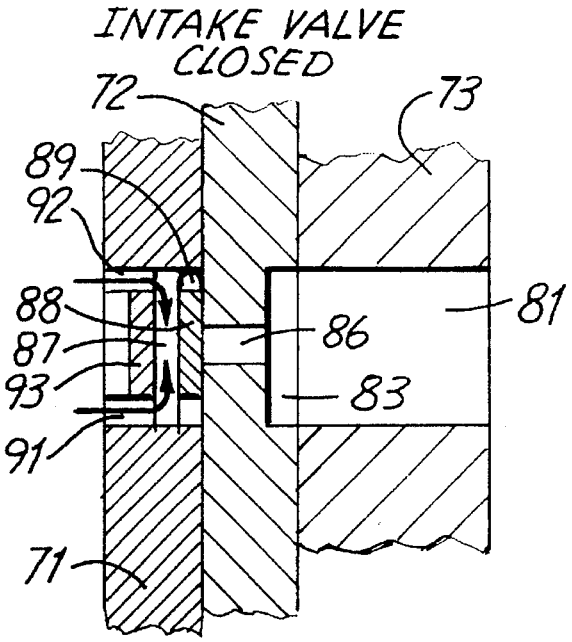
FIG. 17 is a sectional view similar to FIG. 16 showing the intake valving ring in the closed position.

As seen in FIGS. 16–19, end cap 73 has a fluid intake port 81 and a fluid exhaust port 82. Intake port 81 is open to an annular groove 83 in exhaust valve plate 72. Exhaust port 82 is open to an annular groove or chamber 84 in the inside of end cap 73. Plate 72 has a plurality of circumferentially-arranged arcuate segment slots 86 open to groove 83 and an annular groove 87 in intake valve plate 71. A flat circular valving ring 88 is movably disposed in annular groove 87 and moves from an open position, as shown in FIG. 16, to a closed position, as shown in FIG. 17, wherein the arcuate segment slots 86 are closed. Valving ring 88 has a plurality of outwardly-directed circumferentially-spaced projections or ears 89 to centrally locate valving ring 89 in groove 87. Plate 71 has arcuate segment slots or passages 91 and 92 located on opposite sides of a stop or member 93. When valving ring 88 is in the open position, it bears against stop 93, whereby fluid can flow through intake port 81, annular groove 83, segment slots 86, annular groove 87 and the segment passages 91 and 92 into the pumping chamber. When the pressure in the pumping chamber is increased, the valving ring 88 moves to the closed position against the exhaust valve plate 72, as seen in FIG. 17, closing the arcuate segment slots 86.

Figure 18:
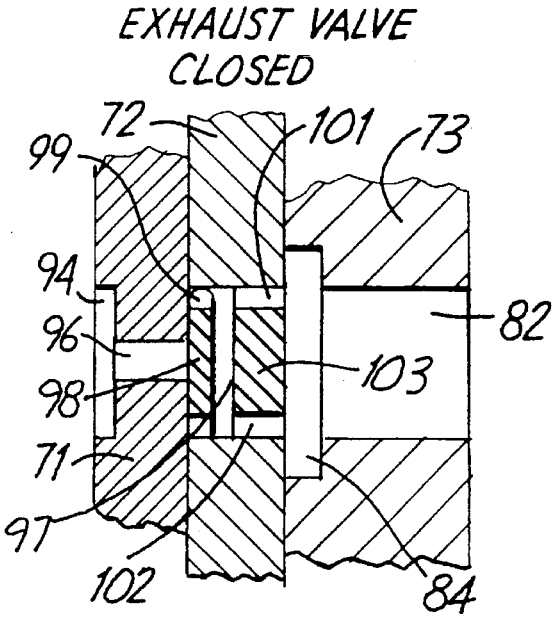
FIG. 18 is a sectional view showing the valve assembly with the exhaust valving ring in the closed position.
Figure 19:
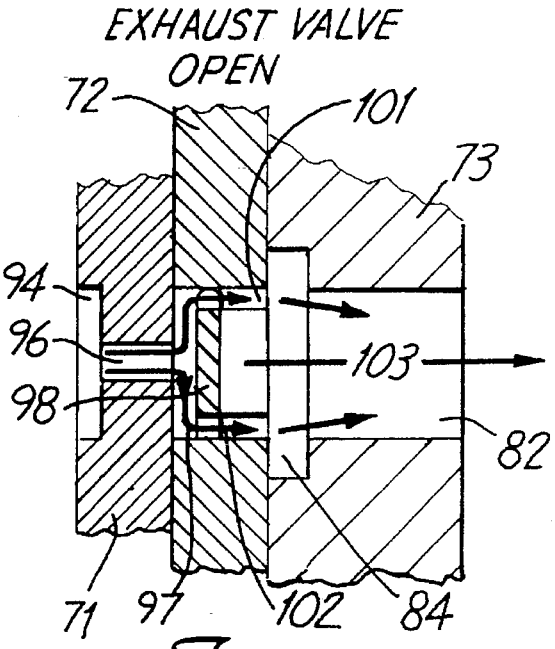
FIG. 19 is a sectional view showing the exhaust valving ring in the open position.

As seen in FIGS. 18 and 19, intake valve plate 71 has an internal annular groove or chamber 94 open to arcuate segment slots 96. Slots 96 are open to a groove 97 in exhaust valve plate 72. An annular circular flat valving ring 98 is movably disposed in groove 97 for movement to a closed position, as shown in FIG. 18, to an open position, as shown in FIG. 19, whereby air from the pumping chamber can be exhausted through the fluid exhaust port 82. Annular valving member 98 has a plurality of outwardly-directed circumferentially-spaced projections or ears 99 that centrally locate valving ring 98 relative to groove 97. Valving plate 72 has concentric circumferentially-spaced segment slots or passages 101 and 102 open to groove 97 and groove 84 in end cap 73. A stop or member 103 is located between slots 101 and 102 and functions as a stop or abutment for valving ring 98 when in the open position, as shown in FIG. 19. When piston assembly 36 moves on the intake stroke, the valving ring 98 is in the closed position covering segment slots 96, as seen in FIG. 18. When piston assembly 36 is in the compression stroke, the valving member 98 moves against stop 103 whereby the passage from the pumping chamber to the exhaust port 82 is open to allow fluid under pressure to flow through the exhaust port 82 to a desired location.

Figure 8:
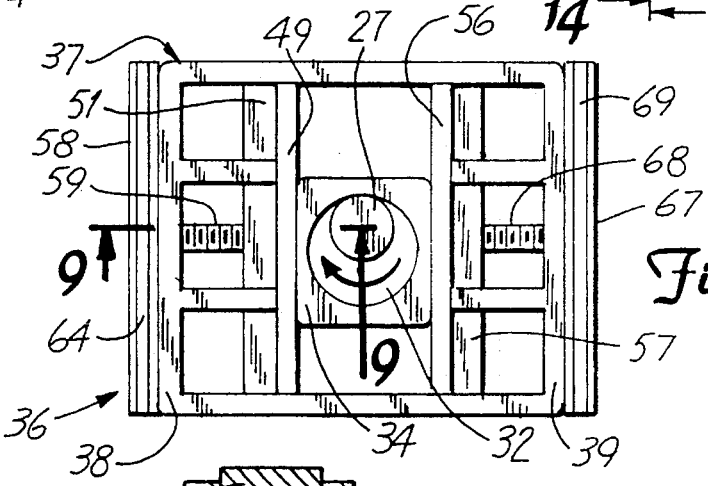
FIG. 8 is a sectional view of the piston assembly taken along the line 8—8 of FIG. 7.

In use, shaft 27 of pump 10 is connected to a prime mover, such as an electric motor, internal combustion engine, air motor, fluid motor and the like, operable to rotate shaft 27. As seen in FIG. 8, when shaft 27 is rotated, the concentric member 32 rotates in the direction of the arrow to reciprocate block 34. This moves piston assembly 36 in sequential opposite directions. The first and second pistons 58 and 67 are reciprocated in their respective pumping chambers 25A and 25B. When piston 58 moves in the compression cycle, piston 67 moves in the intake cycle drawing air into piston pumping chamber 25A and compressing the air in piston pumping chamber 25B. The seal assemblies 64 on the outer peripheral edges of the first and second pistons 58 and 67 slide in internal surface 23 of housing 11. When piston 58 moves in the intake episode, valving ring 88 moves against stop 93, whereby air can flow through intake port 81 and segment slots 91 and 92 into pumping chamber 25A. Exhaust valve ring 97 is moved to the closed position against valve plate 71 closing segment seals 96, as seen in FIG. 18. When piston 58 moves in the compression stroke direction, the intake valve is closed, as shown in FIG. 8, wherein valving ring 88 bears against plate 72 closing the segment slots 86. The exhaust valve is open, as shown in FIG. 19, with valving ring 98 against stop 103 whereby the fluid under pressure in pumping chamber 25A can flow through the segment slots 96, 101 and 102 and through exhaust port 82 to a desired location, such as a fluid pressure receiver. The second piston 87 works in the same manner in a timed relationship that is opposite to the intake and compression strokes of the first piston 58.

While there has been shown and described a preferred embodiment of the double acting pump of the invention, it is understood that changes in the structure, arrangement of structure and types of structures, may be made by those skilled in the art without departing from the invention. The invention is defined in the following claims.

I claim:

1. A pump for moving fluid comprising: a housing having a first and second end and an internal chamber extended between said first and second ends, a piston assembly having a first end and a second end located within said chamber, said piston assembly having a first piston at the first end thereof and a second piston at the second end thereof, means mounted on the housing operable to move the piston assembly and first and second pistons in said chamber, said piston assembly includes a body having a first wall and a second wall on opposite ends of the body, a first plate located adjacent the inside of the first wall, a second plate located adjacent the inside of the second wall, means securing the first piston to the first wall and the first plate to the first wall, means securing the second piston to the second wall and the second plate to the second wall, said first and second plates being laterally spaced from each other, said means mounted on the housing operable to move the piston assembly including a shaft rotatably mounted on the housing, an eccentric member joined to said shaft, and a block having a bore accommodating the eccentric member, said block having opposite sides engageable with said first and second plates whereby said block has reciprocating movement in response to rotation of the shaft thereby moving the piston assembly in said chamber to pump said fluid, first valve plate means mounted on the first end of the housing closing one end of the chamber, second valve plate means mounted on the second end of the housing closing the other end of the chamber, each of said first and second valve plate means having a fluid intake valve allowing fluid to flow into the internal chamber and a fluid exhaust valve allowing fluid to flow out of the internal chamber, a first end cap located in engagement with the first valve plate means, means securing the first end cap and first valve plate means to the first end of the housing, a second end cap located in engagement with the second valve plate means, and means securing the second end cap and second valve plate means to the second end of the housing, said first and second end caps having fluid intake and fluid exhaust ports allowing fluid to flow toward and away from the first and second valve plate means in response to movement of the piston assembly in said chamber.

2. The pump of claim 1 wherein: said housing has internal walls having generally flat surfaces surrounding the internal chamber, said first piston and second piston each having outer peripheral edges located adjacent said surfaces.

3. The pump of claim 2 wherein: said first and second pistons each include seal means mounted on the outer peripheral edges thereof located in sliding sealing engagement with said surfaces.

4. The pump of claim 1 wherein: said housing has a generally square cross sectional shape and an internal surface having a generally square cross sectional shape, said first and second pistons each having a square shape complimentary to the cross sectional shape of the internal surface, said first and second pistons each having outer peripheral edges located adjacent said internal surface.

5. The pump of claim 4 wherein: said first and second pistons each include seal means mounted on the outer peripheral edges thereof located in sliding sealing engagement with said surfaces.

6. The pump of claim 1 wherein: said means mounted on the housing operable to move the piston assembly includes a shaft rotatably mounted on the housing, an eccentric member joined to said shaft, and a block having a bore accommodating the eccentric member, said block having reciprocating movement in response to rotation of the shaft thereby moving the piston assembly in said chamber to pump said fluid.

7. A pump for moving fluid comprising: a housing having a first and second end and an internal chamber extended between said first and second ends, a piston assembly having a first end and a second end located within said chamber, said piston assembly having a first piston at the first end thereof and a second piston at the second end thereof, means mounted on the housing operable to move the piston assembly and first and second pistons in said chamber, first valve plate means mounted on the first end of the housing closing one end of the chamber, second valve plate means mounted on the second end of the housing closing the other end of the chamber, each of said first and second valve plate means having a fluid intake valve allowing fluid to flow into the internal chamber and a fluid exhaust valve allowing fluid to flow out of the internal chamber, a first end cap located in engagement with the first valve plate means, means securing the first end cap and first valve plate means to the first end of the housing, a second end cap located in engagement with the second valve plate means, and means securing the second end cap and the second valve plate means to the second end of the housing, said first and second end caps having fluid intake and fluid exhaust ports allowing fluid to flow toward and away from the first and second valve plate means in response to movement of the piston assembly in said chamber, each of said first and second valve plate means includes a first valve plate having an annular chamber, and a second valve plate having a plurality of openings open to said annular chamber and a fluid intake port in an end cap, said first valve plate having passages open to a piston chamber and said annular chamber, said fluid intake valve having a valve ring located in said annular chamber movable into engagement with said second valve plate to close said openings and movable away from said second valve plate to allow fluid to flow through said fluid intake port, openings, annular chamber and passages into the pumping chamber.

8. The pump of claim 7 wherein: said valve ring is a flat annular member.

9. A pump for moving fluid comprising: a housing having a first and second end and an internal chamber extended between said first and second ends, a piston assembly having a first end and a second end located within said chamber, said piston assembly having a first piston at the first end thereof and a second piston at the second end thereof, means mounted on the housing operable to move the piston assembly and first and second pistons in said chamber, first valve plate means mounted on the first end of the housing closing one end of the chamber, second valve plate means mounted on the second end of the housing closing the other end of the chamber, each of said first and second valve plate means having a fluid intake valve allowing fluid to flow into the internal chamber and a fluid exhaust valve allowing fluid to flow out of the internal chamber, a first end cap located in engagement with the first valve plate means, means securing the first end cap and first valve plate means to the first end of the housing, a second end cap located in engagement with the second valve plate means, and means securing the second end cap and the second valve plate means to the second end of the housing, said first and second end caps having fluid intake and fluid exhaust ports allowing fluid to flow toward and away from the first and second valve plate means in response to movement of the piston assembly in said chamber, each of said first and second valve plate means includes a first plate having arcuate segment slots open to the piston chamber, and a second plate having an annular chamber open to said segment slots and passages open to the chamber and a fluid exhaust port in an end cap, said fluid exhaust valve having an annular valve ring located in said annular chamber movable into engagement with said first valve plate to close said segment slots and movable away from said first valve plate to allow fluid to flow from the piston chamber through said arcuate slots, annular chamber, passages and exhaust fluid port.

10. The pump of claim 9 wherein: said valve ring is a flat annular member.

11. A pump for moving fluid comprising: a housing having a first and second ends, a piston assembly having a first end and a second end located within said chamber, said piston assembly having a first piston at the first end thereof and a second piston at the second end thereof, means mounted on the housing operable to move the piston assembly and first and second pistons in said chamber, first valve plate means mounted on the first end of the housing closing one end of the chamber, second valve plate means mounted on the second end of the housing closing the other end of the chamber, each of said first and second valve plate means having a fluid intake valve allowing fluid to flow into the internal chamber and a fluid exhaust valve allowing fluid to flow out of the internal chamber, a first end cap located in engagement with the first valve plate means, means securing the first end cap and first valve plate means to the first end of the housing, a second end cap located in engagement with the second valve plate means, and means securing the second end cap and the second valve plate means to the second end of the housing, said first and second end caps having fluid intake and fluid exhaust ports allowing fluid to flow toward and away from the first and second valve plate means in response to movement of the piston assembly in said chamber, each of said first and second valve plate means includes a first valve plate having a first annular chamber, and a second valve plate having a plurality of arcuate segment slots open to said first annular chamber and a fluid intake port in an end cap, said first valve plates having arcuate segment passages open to a piston chamber and said first annular chamber, said fluid intake valve having an annular valve ring located in said first annular chamber movable into engagement with said second valve plate to close said segment slots and movable away from said second valve plate to allow fluid to flow through said fluid intake port, segment slots, first annular chamber and passages into the pumping chamber, the first plate having arcuate segment slots open to the piston chamber, said second plate having a second annular chamber to said segment slots in the first plate and passages open to the chamber and a fluid exhaust port in an end cap, said fluid exhaust valve having an annular valve ring located in said second annular chamber movable into engagement with said first valve plate to close said segment slots in the first plate and movable away from said first valve plate to allow fluid to flow from the piston chamber through said slots in the first plate, second annular chamber, passages in the second plate and exhaust fluid port.

12. The pump of claim 11 wherein: each valve ring is a flat annular member.

13. An apparatus for compressing fluid comprising: a housing having a first and second end an internal chamber extended between said first and second ends, a piston assembly having a first end and a second end located within said chamber, said piston assembly having a first piston at the first end thereof and a second piston at the second end thereof, means mounted on the housing operable to move the piston assembly, and first and second pistons in said chamber, first valve means mounted on the first end of the housing closing one end of the chamber, second valve means mounted on the second end of the housing closing the other end of the chamber, each of said first and second valve means having a fluid intake valve allowing fluid to flow into the internal chamber and a fluid exhaust valve allowing fluid to flow out of the internal chamber, a first end cap located in engagement with the first valve means, means securing the first end cap and first valve means to the first end of the housing, a second end cap located in engagement with the second valve means, and means securing the second end cap and second valve means to the second end of the housing, said first and second end caps having fluid intake and fluid exhaust ports allowing fluid to flow toward and away from the first and second valve means in response to movement of the piston assembly in said chamber, said first and second valve means each including a first valve plate having an annular chamber, and a second valve plate having a plurality of openings open to said annular chamber and a fluid intake port in an end cap, said first valve plate having passages open to a piston chamber and said annular chamber, said fluid intake valve having an annular valve ring located in said annular chamber movable into engagement with said second valve plate to close said openings and movable away from said second valve plate to allow fluid to flow through said fluid intake port, openings, annular chamber and passages into the pumping chamber.

14. The apparatus of claim 13 wherein: said housing has inside walls having generally flat surfaces surrounding the internal chamber, said first piston and second piston each having outer peripheral edges located adjacent said surfaces, said first and second pistons each include seal means mounted on the outer peripheral edges thereof located in sliding sealing engagement with said surfaces.

15. The apparatus of claim 13 wherein: said housing has a generally square cross sectional shape and an internal surface having a generally square cross sectional shape, said first and second pistons each having a square shape complimentary to the cross sectional shape of the internal surface, said first and second pistons each having outer peripheral edges located adjacent said internal surface.

16. The apparatus of claim 13 wherein: said means mounted on the housing operable to move the piston assembly includes a shaft rotatably mounted on the housing, an eccentric member joined to said shaft, and a block having a bore accommodating the eccentric member, said block having reciprocating movement in response to rotation of the shaft thereby moving the piston assembly in said chamber to pump said fluid.

17. The apparatus of claim 13 wherein: said piston assembly includes a body having a first wall and a second wall on opposite ends of the body, a first plate located adjacent the inside of the first wall, a second plate located adjacent the inside of the second wall, means securing the first piston to the first wall and the first plate to the first wall, means securing the second piston to the second wall and the second plate to the second wall, said first and second plates being laterally spaced from each other, said means mounted on the housing operable to move the piston assembly including a shaft rotatably mounted on the housing, an eccentric member joined to said shaft, and a block having a bore accommodating the eccentric member, said block having opposite sides engageable with said first and second plates whereby said block has reciprocating movement in response to rotation of the shaft thereby moving the piston assembly in said chamber to pump said fluid.

18. An apparatus for compressing fluid comprising: a housing having a first and second end and an internal chamber extended between said first and second ends, a piston assembly having a first end and a second end located within said chamber, said piston assembly having a first piston at the first end thereof and a second piston at the second end thereof, means mounted on the housing operable to move the piston assembly, and first and second pistons in said chamber, first valve means mounted on the first end of the housing closing one end of the chamber second valve means mounted on the second end of the housing closing the other end of the chamber, each of said first and second valve means having a fluid intake valve allowing fluid to flow into the internal chamber and a fluid exhaust valve allowing fluid to flow out of the internal chamber, a first end cap located in engagement with the first valve means, means securing the first end cap and first valve means to the first end of the housing, a second end cap located in engagement with the second valve means, and means securing the second end cap and second valve means to the second end of the housing, said first and second end caps having fluid intake and fluid exhaust ports allowing fluid to flow toward and away from the first and second valve means in response to movement of the piston assembly in said chamber, said first and second valve means each including a first plate having arcuate segment slots open to the piston chamber, said second plate having an annular chamber to said segment slots and passages open to the chamber and a fluid exhaust port in an end cap, said fluid exhaust valve having an annular valve ring located in said annular chamber movable into engagement with said first valve plate to close said segment slots and movable away from said first valve plate to allow fluid to flow from the piston chamber through said arcuate slots, annular chamber, passages and exhaust fluid port.

19. An apparatus for compressing fluid comprising: a housing having a first and second end and an internal chamber extended between said first and second ends, a piston assembly having a first end and a second end located within said chamber, said piston assembly having a first piston at the first end thereof and a second piston at the second end thereof, means mounted on the housing operable to move the piston assembly, and first and second pistons in said chamber, first valve means mounted on the first end of the housing closing one end of the chamber second valve means mounted on the second end of the housing closing the other end of the chamber, each of said first and second valve means having a fluid intake valve allowing fluid to flow into the internal chamber and a fluid exhaust valve allowing fluid to flow out of the internal chamber, a first end cap located in engagement with the first valve means, means securing the first end cap and first valve means to the first end of the housing, a second end cap located in engagement with the second valve means, and means securing the second end cap and second valve means to the second end of the housing, said first and second end caps having fluid intake and fluid exhaust ports allowing fluid to flow toward and away from the first and second valve means in response to movement of the piston assembly in said chamber, said first and second valve means each including a first valve plate having a first annular chamber, said second valve plate having a plurality of arcuate segment slots open to said first annular chamber and a fluid intake port in an end cap, said first valve plates having arcuate segment passages open to a piston chamber and said first annular chamber, said fluid intake valve having an annular valve ring located in said first annular chamber movable into engagement with said second valve plate to close said segment slots and movable away from said second valve plate to allow fluid to flow through said fluid intake port, segment slots, first annular chamber and passages into the pumping chamber, the first plate having arcuate segment slots open to the piston chamber, said second plate having a second annular chamber to said segment slots in the first plate and passages open to the chamber and a fluid exhaust port in an end cap, said fluid exhaust valve having an annular valve ring located in said second annular chamber movable into engagement with said first valve plate to close said segment slots in the first plate and movable away from said first valve plate to allow fluid to flow from the piston chamber through said slots in the first plate, second annular chamber, passages in the second plate and exhaust fluid port.

* * * * *